United States Patent [19]

Robillard

[11] 4,394,439

[45] Jul. 19, 1983

[54] NON-SILVER X-RAY RECORDING PROCESS

[76] Inventor: Jean J. Robillard, 46 Arnold Rd., Pelham, Mass. 01002

[21] Appl. No.: 267,685

[22] Filed: May 28, 1981

[51] Int. Cl.[3] ..... G03C 5/24

[52] U.S. Cl. ..... 430/336; 430/967; 430/916; 430/341; 430/332; 430/344; 430/345

[58] Field of Search ..... 430/336, 967, 341, 337, 430/916, 332, 344, 345

[56] References Cited

U.S. PATENT DOCUMENTS

| | | | |
|---|---|---|---|
| 2,772,159 | 11/1956 | Elliott et al. | 430/336 |
| 3,441,411 | 4/1969 | Amidon et al. | 430/345 |
| 3,810,763 | 5/1974 | Laridon et al. | 430/345 |
| 3,957,515 | 5/1976 | Robillard | 430/345 |
| 4,052,218 | 10/1977 | Samat et al. | 430/345 |
| 4,065,315 | 12/1977 | Yamazaki et al. | 430/344 |

*Primary Examiner*—Won H. Louie, Jr.

*Attorney, Agent, or Firm*—Sherman & Shalloway

[57] ABSTRACT

Permanent records of X rays or radiations of shorter wavelengths are formed on a film substrate by direct exposure to the radiation and heat development. The process is not sensitive to visible radiation and can therefore be carried on in daylight. An X ray photosensitive film containing a halogenated photodegradable polymer and an aryl dye promoter reacting to free radicals is exposed to an X ray image and then heated under conditions which allow the free radical generated by the photodegradation of the polymer to migrate and react with the aryl dye promoter to provide the imaging dye. The X ray photosensitive layer of the X ray photosensitive film or paper includes, in addition to the photodegradable polymer and the aryl dye promoter, a heat activable complexing agent and an organic binder. The process can be carried out using currently available X ray equipment with the advantage of handling the film in daylight and eliminating chemical development.

10 Claims, 5 Drawing Figures

Polymethylmethacrylate

Polyisobutylene

Polydimethylsiloxane

Polytetrafluoroethylene

NON-SILVER X-RAY RECORDING PROCESS

BACKGROUND OF THE INVENTION

1. Field of the Invention

The present invention relates to a novel X ray image recording system. In one aspect, the invention relates to the permanent recording of images or objects on a sensitive surface by irradiation with X rays or other radiations of shorter wavelengths. In another aspect, the invention relates to a new image recording substrate sensitive to radiation with wavelengths shorter than fifty angstroms. In still another aspect, the invention relates to a new and novel X ray photographic process in which an image is reproduced without the conventional developing step.

2. Discussion of the Prior Art

Present recording systems for X rays use mostly silver halide emulsions. The world consumption of X ray films exceeds that of amateur and industrial photography. The amount of silver in X ray material is far greater than for ordinary photography, and the recent increase in the price of silver has already affected the consumer.

A variety of silver based radiographic films or papers adapted for various applications are found on the market. They are produced by major photographic companies such as Eastman Kodak, Dupont, Agfa Gevaert, Ilford, Fuji, etc. Medical radiography uses mostly films giving negative images, paper finds application in industrial radiography and gammagraphy.

Xerographic systems for radiography have been introduced recently. They are presently the only practical alternative for silver halide radiography. The method utilizes selenium plates instead of the conventional drum used in xerographic photocopy. Such plates, which have been previously electrostatically charged, are exposed to the X ray image in the absence of light, and transferred into a development machine which applies toner selectively on the plate and then transfers and fixes the toner image onto a glossy bristol paper or a plastic film. Radioxerography has a sensitivity approaching that of silver halide radiography. It generally provides a positive image on an opaque substrate, which creates a problem for physicians who are accustomed to negative transparencies. It is, nevertheless, gradually accepted in the medical world.

Radioxergaphy, like xerographic photocopy, offers the advantage of dry processing, but at the cost of more expensive and cumbersome equipment requiring specialized maintenance.

SUMMARY OF THE INVENTION

An object of this invention is to provide a novel photographic composition sensitive to X rays and other ionizing radiations.

Another object of this invention is to provide a dry process for the recording of X ray images.

Another object of this invention is to provide a process which is not sensitive to ambient light but only to X rays and radiations with a wavelength shorter than fifty angstroms.

Still another object of this invention is to provide a more sensitive dry process for the recording of X ray images and the like.

Still another object of this invention is to provide a process which requires only the application of heat to produce a permanent image after exposure to X rays.

Yet another object of this invention is to provide a novel X ray sensitive film or paper.

Another object of this invention is to provide a process for developing and an image producing composition which can be developed and fixed in a single operation.

Yet another object is to provide an image producing composition which upon exposure to X rays may be developed without a separate wet developing process or a separate electrostatic process.

Various other objects and advantages will become apparent to those skilled in the art from the accompanying description and disclosure.

According to the invention, the X ray photographic system comprises an image forming compositon and a separate X ray sensitive polymer. The image forming system is supported by an X ray sensitive polymer carrier sheet. The carrier sheet or sensitive material containing the image reproduction system is then exposed to the image or the source of X rays and the material to be photographed directly forms a latent image upon exposure. This latent image is thereafter developed by exposition to heat.

The image forming composition of the photographic system is a photodegradable polymer which is capable to generate free radicals upon photodegration initiated by X ray radiation. The free radicals are made to react with a dye forming material to produce a dye which is further complexed with a metal salt to increase its contrast. The recording mechanism is illustrated in FIG. 1.

DETAILED DESCRIPTION OF THE INVENTION AND PREFERRED EMBODIMENTS

The photodegradation of polymers is of current occurrence. It is a common fact that most of the plastic materials exposed to sunlight lose their transparency with time and become colored. Plastic components in X ray equipment have a similar behavior when they are exposed to the radiation. Photodegradation produces profound modifications in the physical and chemical structure of the irradiated material. These modifications can be utilized for permanently recording the irradiation of the material and the distribution of this irradiation imagewise when such is the case.

Physical modification affects the optical, thermal, electrical and mechanical properties of the material.

Chemical modification can change the reactivity or the chemical composition of the material, producing new active species (new molecules, reactive groups, ions, free radicals) which are either localized or free to move in the lattice of the material. In the second alternative, the active species produced by the photodegradation can be made to move to the surface and react with an image forming system to provide a permanent record.

It is known that polymers are made of the linear repetition of monomeric entities forming long polymeric chains. When the monomeric group constituting the chain remains reactive, it can react with another identical group of another chain, thereby providing a link with the other chain and the resulting polymer is therefore called cross-linked.

Figure 1:
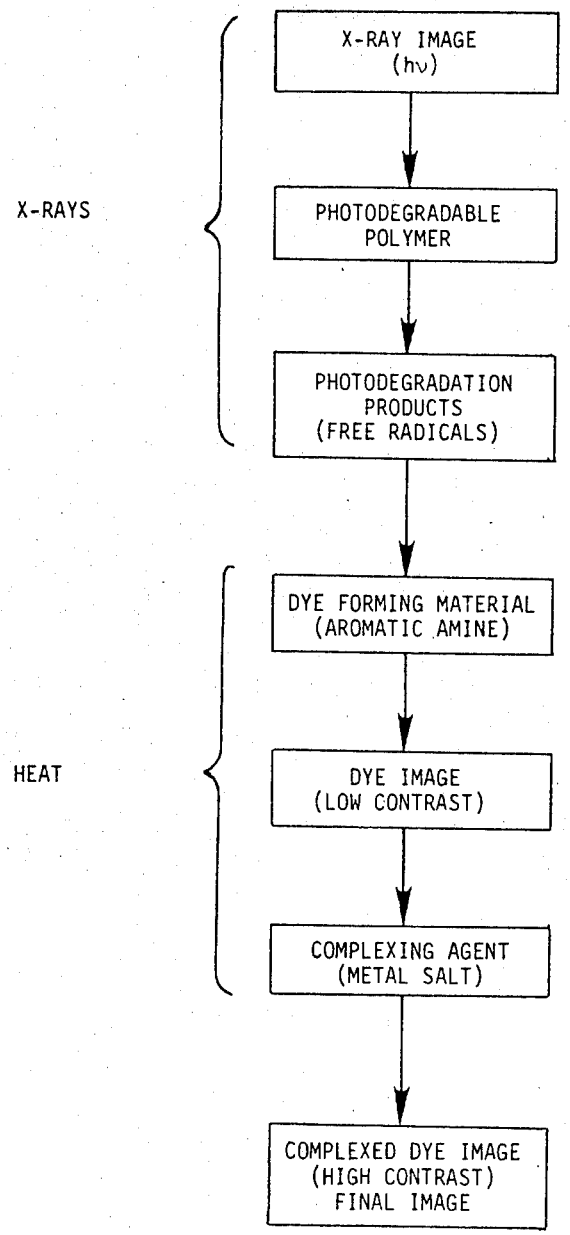
FIG. 1 illustrates the sequence of operations leading to the formation of an image according to the invention.
Figure 2:
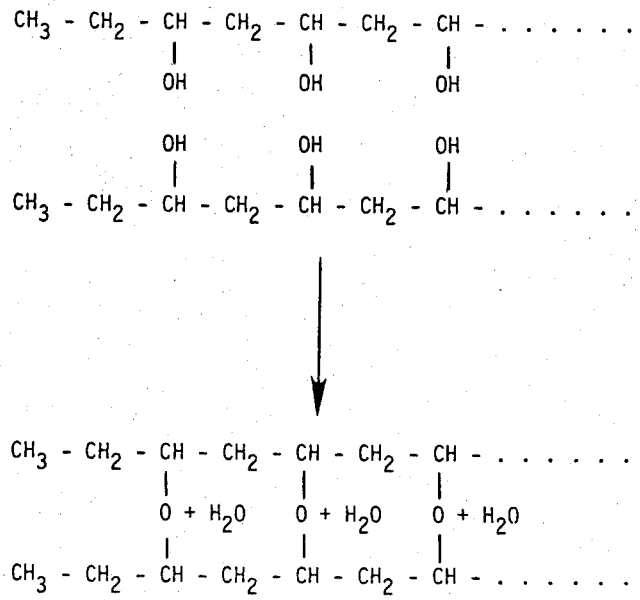
FIG. 2 describes the cross-linking of a polymer involving only the molecules of the polymer.
Figure 3:
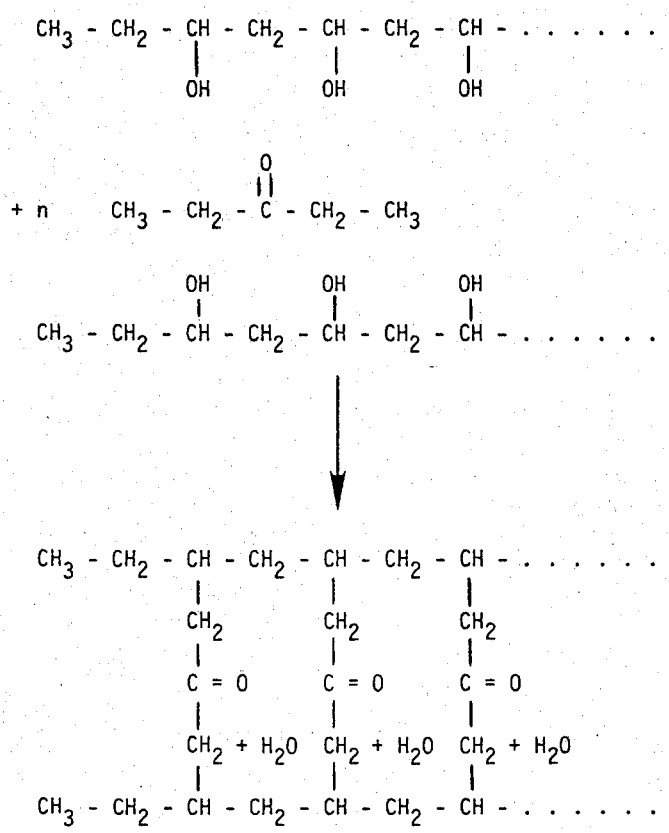
FIG. 3 describes the cross-linking of a polymer involving a third component to provide the linkage between the molecules of the polymer.

The cross-linking of a polymer can involve only certain reactive groups of the polymer itself (FIG. 2) or involve a third component which enters into the linkage (FIG. 3).

In linear polymers, the photodegradation can produce a depolymerization by breaking the bonds between monomers, extracting monomers or groups of monomers (dimers, trimers, etc), or breaking a reactive group in the monomer itself.

In cross-linked polymers, the photodegradation generally breaks the cross-linkage, and depending on its complexity and the energy involved, the entire link or part of it can be made free. Naturally degradation of the linear part of the structure can also take place simultaneously.

The ability for a polymer to be photodegradable depends on its absorption for the radiation responsible for the degradation, as well as the binding energy of the bond that will be affected by the degradation. As photodegradation always involves the rupture of one or several chemical bonds, the absorption of the radiation should be localized on the bond itself or in its immediate vicinity, and such a bond should be weak enough to be broken by the energy provided during the absorption process. Most of the time, the energy will not be absorbed by the bond itself but by another structure in its vicinity, and the energy will be transferred to the bond with a certain efficiency $\eta$. Or the energy will be absorbed far away from the breakable bond and be transferred through a secondary mechanism (as in charge transfer complexes and sensitizers).

The two criteria for photodegradation being radiation absorption and bond dissociation energy, one can optimize the processes in acting on these two parameters.

It is known in photochemistry that absorption in the higher end of the spectrum (UV, visible, IR) can be promoted by spectral sensitization using certain dyes which will transfer energy to the sensitized molecule. Similar results can be obtained for X rays and higher energy radiation by introducing heavy metal atoms in the structure.

The weakness of the bond to be broken by photodegradation is generally depending on the basic chemical structure of the polymer, that is, the original monomer or the reactive groups responsible for the cross-linking. This particular bond should be in a position to receive the energy transferred by the part of the molecule which absorbs the radiation.

To design and optimize a photodegradable polymer sensitive to X rays, one should look for or synthesize polymers containing heavy metal atoms in their structure and establish in the structure of such polymer an easy transfer of the energy absorbed in the metal to low dissociation energy bonds.

Figure 4:
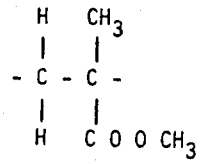
FIG. 4 describes the structure of various polymer producing free radicals by photodegradation.
Figure 4:
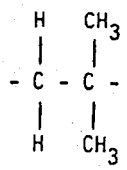
Figure 4:
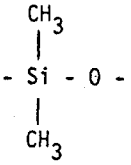
Figure 4:
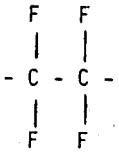

Free radicals are often produced during photodegradation. This is the case of the polymers represented in FIG. 4.

The type of image forming reaction selected for recording makes use of halogenated free radicals which are provided by the last example in the form of $\cdot CF_3$.

Figure 5:
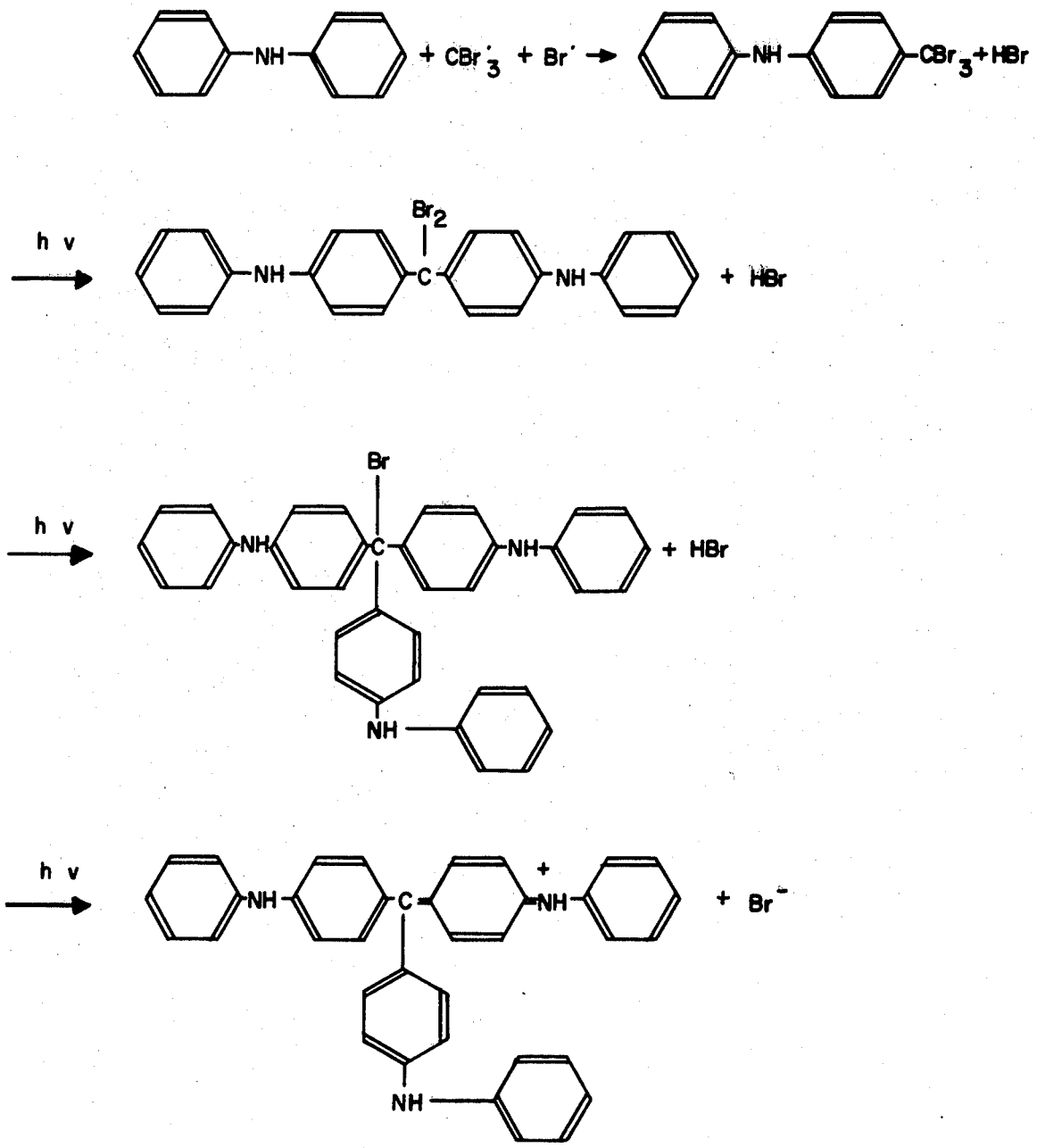
FIG. 5 illustrates an example of dye formation resulting from the action of free radicals on an aromatic dye promoter.

The halogenated free radicals produced by photodegration of halogenated polymers will react with an aromatic amine to form a triarylmethane dye by condensation, as represented in FIG. 5.

Alternative mechanisms can be used for image formation starting from the same basic reaction. For example, the bromine free radical extracting a hydrogen atom gives hydrogen bromide, which can convert a leuco base into its colored form. Also, the bromide can be used to oxidize leuco dyes to the colored forms.

These techniques are well known in the graphic arts, and a number of organic systems can be made to react with the free radicals produced by photodegradation of halogenated polymers. Listed below are some possible systems applicable to the present invention:

Arylindolizines
Arylamines and aldehydes
Leuco triphenylmethane
Leuco-p-diaminostyryl bases
Leuco cyanine bases
Leuco xanthine dyes
Leuco dyes with N-vinylcarbazol
Leuco merocyanine with N-vinylcarbazol
4(p-dimethylaminostyryl) quinoline
Crystal violet lactone
Spiropyrans.

The images obtained are generally lower in density than silver halide images, and therefore, a complexation of the dye with a metal salt is necessary.

Organic mineral salts such as the metal salts of behenic acid, naphthenic acid and stearic acid with such metals as lead, zinc, barium, copper and cobalt can be used.

Generally, the image forming layer includes from 0.01 to 1 gram per square meter of the dye former and from about 0.1 to 2 grams per square meter of the complexing agent. The dye former and complexing agent are uniformly dispersed in an organic binder which is deposited on the film substrate to form the image forming layer. An amount of the organic binder sufficient to form an image forming layer having a thickness in the range of from about 1 to 10 microns is sufficient. Any organic binder which softens at the temperature of the heating step, for example, from about 100° C. to 150° C., can be used.

Photodegradable polymers useful for this process include the commercial products listed below:

(a) The polyhexafluoropropylene:

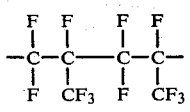

(b) The vinylidene fluoride - hexafluoropropylene copolymer:

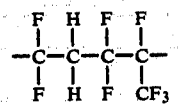

(c) The tetrafluoroethylene - nitrosofluoromethane copolymer:

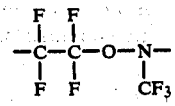

(d) The tetrafluoroethylene - nitrosochloromethane copolymer:

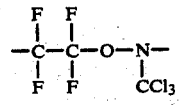

(e) The tetrafluoroethylene - nitrosobromomethane copolymer:

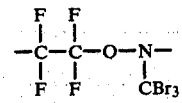

Complexation of these structures with heavy metals such as Mo, Co, Pb, U and Ta, together with cross-linking, considerably improves the sensitivity of the system as with the following polymers:

(f) The copper (II) complex of polyaminoquinone:

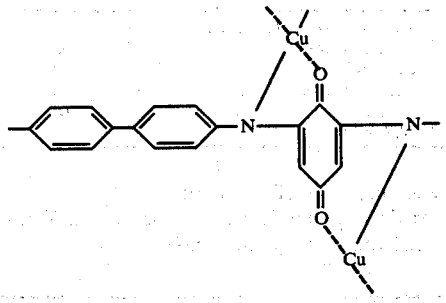

(g) The copper (I) complex of poly 1,4 phenylenebis (dithiocarbamic acid):

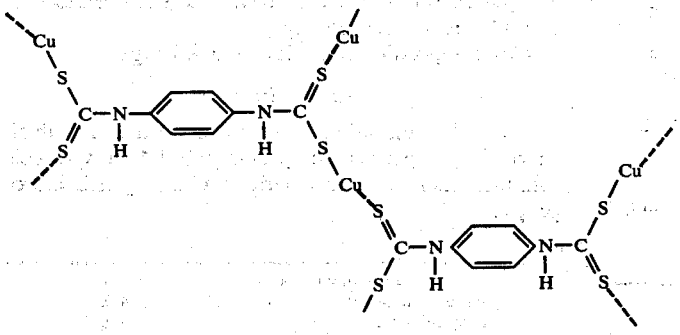

The photodegradable halogenated polymer which forms the substrate of the photosensitive film according to the invention may have a thickness in the range of from about 0.05 to 3 millimeters.

In carrying out the process of the invention, the photosensitive film is photographically exposed to an x-ray image to imagewise photodegrade the polymer and selectively generate halogenated free radicals. The exposed photosensitive film is then heated to allow the imagewise generated halogenated radicals to react with the dye former to thereby form a dye image. The dye image forms a complex with the complexing agent to provide the final dye complex image. Generally, the heating step can be carried out at a temperature in the range of from about 100° C. to about 150° C. for a time varying from about 0.05 to about 10 seconds.

The invention will now be described in connection with specific embodiments which are provided as illustrative examples only, and not by way of limitation.

EXAMPLE 1

The following solution is coated on a 3 mm thick sheet of polyhexafluoropropylene:

| | |
|---|---|
| 1-methyl-2-phenylindolizine (Preparation described in Bailey J. British Pat. No. 999,874) | 0.5 g |
| 4-aminodiphenylamine | 0.4 g |
| Ethylcellulose | 5 g |
| Lead naphtenate | 0.65 g |
| Methylene Chloride | 100 cc |

to a wet thickness of 10 microns.

After drying, the film is exposed to an X ray image under the following conditions:

| | |
|---|---|
| Distance to the source: | 50 cm |
| Voltage: | 150 KV |
| Current: | 6 mA |
| Exposure time: | 5 sec. |

and passed through heated rollers at a temperature of 110° C. and a speed of 6 cm/sec.

This composition provides a black recording of the image.

EXAMPLE 2

The following solution is coated on a 3 mm thick sheet of vinylidene fluoride-hexafluoropropylene copolymer:

| | |
|---|---|
| 1-methyl-2-phenylindolizine | 0.4 g |
| 4-dimethylaminobenzaldehyde | 0.25 g |
| Nickel stearate | 0.45 g |
| Ethylcellulose | 3.4 g |
| Ethylmethylketone | 100 cc |

to a wet thickness of 10 microns.

After drying, the film is exposed to an X ray image under the following conditions:

| | |
|---|---|
| Distance to the source: | 50 cm |
| Voltage: | 150 KV |
| Current: | 6 mA |
| Exposure time: | 5 sec. |

and passed through heated rollers at a temperature of 120° C. and a speed of 6 cm/sec.

This composition provides a black-blue recording of the image.

EXAMPLE 3

The following solution is coated on a 3 mm thick sheet of tetrafluoroethylene-nitrosofluoromethane copolymer:

| | |
|---|---|
| 3-ethylthio-4-carbocyanine | 0.4 g |
| Benzene | 70 cc |
| Acetone | 30 cc |
| Cellulose acetobutyrate | 3.4 g |
| Cobalt naphtenate | 0.4 g |

to a wet thickness of 10 microns.

After drying, the film is exposed to an X ray image under the following conditions:

| | |
|---|---|
| Distance to the source: | 50 cm |
| Voltage: | 150 KV |
| Current: | 6 mA |
| Exposure time: | 5 sec. |

and passed through heated rollers at a temperature of 150° C. and a speed of 6 cm/sec.

This composition provides a dark green recording of the image.

EXAMPLE 4

The following solution is coated on a 3 mm thick sheet of tetrafluoroethylene-nitrosochloromethane copolymer:

| | |
|---|---|
| 3'-methyl-spiro(2'H,1'benzopyran-2,2'[2H,1-benzopyran]) | 1 g |
| Ferric stearate | 3.75 g |
| Polyvinylidene chloride | 30 g |
| Methylethylketone | 83 cc |
| Toluene | 17 cc |

to a wet thickness of 10 microns.

After drying, the film is exposed to an X ray image under the following conditions:

| | |
|---|---|
| Distance to the source: | 50 cm |
| Voltage: | 150 KV |
| Current: | 6 mA |

-continued

| | |
|---|---|
| Exposure time: | 3 sec. |

and passed through heated rollers at a temperature of 120° C. and a speed of 6 cm/sec.

This composition provides a dark brown image.

EXAMPLE 5

The following solution is coated on a 3 mm thick sheet of tetrafluoroethylene-nitrosobromomethane copolymer:

| | |
|---|---|
| 4-dimethylaminodiphenylamine | 1 g |
| Copper naphtenate | 3.6 g |
| Ethylcellulose | 5 g |
| Methylene chloride | 100 cc |

to a wet thickness of 10 microns.

After drying, the film is exposed to an X ray image under the following conditions:

| | |
|---|---|
| Distance to the source: | 50 cm |
| Voltage: | 150 KV |
| Current: | 6 mA |
| Exposure time: | 3 sec. |

and passed through heated rollers at a temperature of 150° C. and a speed of 6 cm/sec.

This composition provides a dark image.

EXAMPLE 6

The following solution is coated on a 2 mm thick sheet of the copper (II) complex of polyaminoquinone copolymerized with polyhexafluoropropylene:

| | |
|---|---|
| 3-ethylthio-4-carbocyanine | 0.4 g |
| Cobalt naphtenate | 0.4 g |
| Lead polyacrylate | 3.4 g |
| Cellulose acetobutyrate | 3.4 g |
| Toluene | 70 cc |
| Acetone | 30 cc |

to a wet thickness of 10 microns.

After drying, the film is exposed to an X ray image under the following conditions:

| | |
|---|---|
| Distance to the source: | 50 cm |
| Voltage: | 150 KV |
| Current: | 6 mA |
| Exposure time: | 0.5 sec. |

and passed through heated rollers at a temperature of 110° C. and a speed of 6 cm/sec.

This composition provides a black image.

EXAMPLE 7

The following solution is coated on a 2 mm thick sheet of the copper (I) complex of poly 1,4 phenylenebis (dithiocarbamide) copolymerized with polyhexafluoropropylene:

| | |
|---|---|
| 4-dimethylaminodiphenylamine | 1 g |
| Barium naphtenate | 4 g |
| Ethylcellulose | 3 g |
| Lead polymethacrylate | 2 g |

-continued

| | |
|---|---|
| Methylene chloride | 70 cc |
| Acetone | 30 cc |

to a wet thickness of 10 microns.

After drying, the film is exposed to an X ray image under the following conditions:

| | |
|---|---|
| Distance to the source: | 50 cm |
| Voltage: | 150 KV |
| Current: | 6 mA |
| Exposure time: | 1 sec. |

and passed through heated rollers at a temperature of 120° C. and a speed of 6 cm/sec.

This composition provides a black image.

What is claimed is:

1. A process for forming a permanent record of an X ray image onto a transparent substrate which comprises (A) providing a photosensitive film comprising (1) a film substrate made of a photodegradable halogenated polymer, and (2) an image forming layer on said film substrate, said image forming layer comprising (a) an halogenated free radical sensitive dye former, and (b) a complexing agent, which is an organic metal salt said (a) and (b) being uniformly dispersed in an organic binder;

(B) photographically, imagewise exposing the photosensitive film to an X ray image to imagewise photodegrade the polymer and selectively generate halogenated free radicals; and (C) heating the exposed photosensitive film to allow the imagewise generated halogenated free radicals to react with the dye former to thereby form a dye image and complex the dye with the complexing agent to finally provide a dye complex image.

2. The process according to claim 1 wherein said photosensitive film comprises (1) a film substrate made of a photodegradable polymer selected from the group consisting of polyhexafluoropropylene, the copolymer of vinylidene fluoride and hexafluoropropylene, the copolymer of tetrafluoroethylene and nitrosofluoromethane, the copolymer of tetrafluoroethylene and nitrosochlormethane, the copolymer of tetrafluoroethylene and nitrosobromomethane, the coordinated complex of polyaminoquinone with copper II copolymerized with one of these halogenated polymers and the coordinated complex of poly 1,4 phenylenebis (dithiocarbamic acid) with copper I copolymerized with one of these halogenated polymers; and (2) an image forming layer on said film substrate, said image forming layer made of an image forming composition comprising (a) at least one halogenated free radical sensitive dye former selected from the group consisting of arylamines, arylaldehydes, arylindolizines, spiropyrans, crystal violet lactone, 4-(p-dimethylaminostyryl) quinolines, leuco triphenylmethane, leuco-p-diaminostyryl bases, leucocyanine bases, leuco xanthine bases, leuco dyes with N-vinylcarbazol and leucomerocyanine with N-vinylcarbazol; and (b) at least one complexing agent which is an organic metal salt selected from the group consisting of metal salts of behenic acid, naphthenic acid and stearic acid and said image forming layer being uniformly dispersed in an organic binder which softens at the temperature of the heating step (C) and in the range of about 100° C. to 150° C.

3. The process of claim 2 wherein said film substrate has a thickness in the range of from about 0.05 to 3 mm.

4. The process of claim 2 wherein said image forming layer comprises from 0.01 to 1 g per square meter of (a) and from 0.1 to 2 g per square meter of (b) and the amount of the organic binder is sufficient to form an image forming layer having a thickness in the range of from about 1 to 10 microns.

5. The process of claim 1 wherein step (C) comprises heating the exposed photosensitive film to a temperature in the range of from about 100° C. to about 150° C. for a time varying between 0.5 to 10 sec.

6. The process of claim 1 wherein in said image forming layer said (a) halogenated free radical sensitive dye former is a mixture of 1-methyl-2-phenylindolizine with either 4-aminodiphenylamine or 4-dimethylaminobenzaldehyde, and said (b) complexing agent is lead naphthenate or nickel stearate.

7. The process of claim 1 wherein in said image forming layer said (a) halogenated free radical sensitive dye former is 3-ethylthio-4-carbocyanine and said (b) complexing agent is cobalt naphthenate or a mixture of cobalt naphthenate with lead polyacrylate.

8. The process of claim 1 wherein in said image forming layer said (a) halogenated free radical sensitive dye former is 3'-methyl-spiro (2'H,1'-benzopyran-2,2'(2H,1-benzopyran)), and said (b) complexing agent is ferric stearate.

9. The process of claim 1 wherein in said image forming layer said (a) halogenated free radical sensitive dye former is 4-dimethylaminodiphenylamine, and said (b) complexing agent is copper naphthenate or lead polymethacrylate.

10. The process of claim 2 wherein said complexing agent which is an organic metal salt is selected from the group consisting of lead, zinc, barium copper and cobalt behenates, naphthenates, and stearates.

* * * * *